US008281758B2

(12) United States Patent
Kurihara et al.

(10) Patent No.: US 8,281,758 B2
(45) Date of Patent: Oct. 9, 2012

(54) ENGINE LUBRICATION METHOD

(75) Inventors: Katsumi Kurihara, Nagoya (JP); Shigeo Yamamoto, Fukuyama (JP); Bin Guo, Gu Xian (CN)

(73) Assignee: ETG Limited, Hong Kong (HK)

( * ) Notice: Subject to any disclaimer, the term of this patent is extended or adjusted under 35 U.S.C. 154(b) by 583 days.

(21) Appl. No.: 12/470,006

(22) Filed: May 21, 2009

(65) Prior Publication Data

US 2009/0283067 A1 Nov. 19, 2009

Related U.S. Application Data

(63) Continuation-in-part of application No. 11/903,003, filed on Sep. 20, 2007, now Pat. No. 7,624,714.

(60) Provisional application No. 60/705,708, filed on Aug. 3, 2005.

(51) Int. Cl.

| | |
|---|---|
| ***F01M 1/06*** | (2006.01) |
| ***F01M 11/03*** | (2006.01) |
| ***F01M 3/04*** | (2006.01) |
| ***F01M 1/02*** | (2006.01) |

(52) U.S. Cl. ..... 123/90.33; 123/196 A; 123/196 R; 123/196 CP

(58) Field of Classification Search ..... 123/196 R, 123/196 M, 196 CP, 572, 90.33
See application file for complete search history.

(56) References Cited

U.S. PATENT DOCUMENTS

| | | | | |
|---|---|---|---|---|
| 2,111,242 | A | 3/1938 | Harley | |
| 3,106,263 | A * | 10/1963 | McKellar | 184/106 |
| 4,519,348 | A * | 5/1985 | Hamilton | 123/195 C |
| 5,947,075 | A | 9/1999 | Ryu et al. | |
| 5,950,579 | A * | 9/1999 | Ott | 123/54.4 |
| 5,950,590 | A | 9/1999 | Everts et al. | |
| 5,960,764 | A * | 10/1999 | Araki | 123/196 R |
| 6,019,071 | A * | 2/2000 | Maciejka, Jr. | 123/41.35 |
| 6,202,613 | B1 * | 3/2001 | Nagai | 123/90.34 |
| 6,213,078 | B1 | 4/2001 | Ryu et al. | |
| 6,213,079 | B1 * | 4/2001 | Watanabe | 123/196 R |
| 6,644,288 | B2 * | 11/2003 | Yamada | 123/509 |
| 6,729,292 | B1 * | 5/2004 | Bock et al. | 123/195 C |
| 6,945,215 | B2 * | 9/2005 | Kawamoto et al. | 123/196 W |
| 7,472,675 | B2 * | 1/2009 | Reustle | 123/196 R |
| 2002/0170543 | A1 * | 11/2002 | Yamada | 123/495 |
| 2003/0051680 | A1 * | 3/2003 | Ito et al. | 123/41.86 |
| 2004/0177825 | A1 * | 9/2004 | Kurihara et al. | 123/196 R |
| 2005/0081815 | A1 * | 4/2005 | Ohta et al. | 123/195 C |
| 2005/0279318 | A1 * | 12/2005 | Nagel et al. | 123/196 R |

* cited by examiner

*Primary Examiner* — Nathaniel Wiehe
*Assistant Examiner* — Tea Bajramovic
(74) *Attorney, Agent, or Firm* — Baker & Hostetler LLP

(57) ABSTRACT

A four-cycle engine with an enclosed oil reservoir for mounting on a power tool is provided. An oil pump driven by a camshaft, which mates by a cam gear with crank gear that is driven by a crank shaft, inhales the oil from the oil reservoir to lubricate the engine parts. A circular arc wall surrounds around web of the crankshaft with a slight distance from the web. A scroll-shaped wall has gradually increased distance from the circular arc wall to the direction of rotation of the web and has partial overlap with the circular arc wall. In case of stock of engine oriented power take off side up or down, oil is prevented to flow from oil reservoir to combustion chamber by a weir which is provided between the circular wall and the scrolled wall. The check valve splashes breathing missed oil from the crankshaft to the breather room and causes the oil to supply lubricant to lubricate the engine parts.

28 Claims, 9 Drawing Sheets

C-C

SECTION D-D

ENGINE LUBRICATION METHOD

CROSS-REFERENCE OF RELATED APPLICATIONS

This application is a continuation-in-part application of U.S. patent application Ser. No. 11/903,003 by Kurihara et al., which is a continuation-in-part application of U.S. patent application Ser. No. 11/498,608 by Kurihara, now issued as U.S. Pat. No. 7,287,508, both of which are incorporated herein by reference.

BACKGROUND OF THE INVENTION

1. Field of the Invention

This invention relates to an engine, and more particularly, an engine lubrication method for a small four-cycle internal combustion engine which is particularly suitable for use with portable or transportable power tools.

2. Description of the Related Art

Portable power tools, such as line trimmers, blower/vacuums, and chain saws, are mostly powered by two-cycle internal combustion engines or electric motors. Some transportable power tools, such as tiller/cultivators and generators, are currently powered by two-cycle or four-cycle internal combustion engines. With the growing concern regarding air pollution, there is increasing pressure to reduce the emissions of both portable and transportable power equipment. Electric motors unfortunately have limited applications due to power availability for corded products, and battery life and power availability for cordless devices. In instances where weight is not an overriding factor such as lawn mowers, emissions can be dramatically reduced by utilizing heavier four-cycle engines. When it comes to power tools such as line trimmers, chain saws and blower/vacuums, the use of four-cycle engines pose a very difficult problem. Four-cycle engines tend to be too heavy for a given horsepower output and providing lubrication becomes a very serious problem since portable or transportable power tools must be able to run in a very wide range of orientations (except generators or tiller/cultivators). For some tiller/cultivators powered by four-cycle engines with vertical power shafts, lubrication also becomes a serious problem since it is difficult to use the same lubrication system as engines with horizontal power shafts.

Therefore, it is an object of the present invention to provide a small four-cycle internal combustion engine having low emissions and that is sufficiently light weight to be carried and/or transported by an operator, which is especially suitable for a hand-held or transportable power tool.

It is a further object of the present invention to provide a small four-cycle internal combustion engine having an internal lubrication system that enables the engine to be operated at a wide variety of orientations typically encountered during normal operation, which is especially suitable for a portable or transportable power tool.

It is a further object of the present invention to provide a small lightweight four-cycle engine having an engine block, an overhead valve train and a lubrication system to splash an oil mist to lubricate the crankcase throughout the normal range of operating positions, which is especially suitable for a portable or transportable power tool.

It is yet a further object of the invention to provide a return system of lubricant to return lubrication oil into an oil reservoir after lubricating parts in the crankcase and the overhead valve chamber.

It is yet a further object of the invention to protect oil flow into the combustion chamber when a machine, on which the engine is installed, is kept in an orientation with the engine downside and implement upside. For most of the currently used engine-driven trimmers and brush cutters, it is necessary to satisfy this requirement.

These and other objects, features, and advantages of the present invention will become apparent upon further review of the remainder of the specification and the accompanying drawings.

SUMMARY OF THE INVENTION

In order to achieve the above objects, a four-cycle, internal combustion engine is provided which is suitable for use with portable or transportable power tools. The four-cycle engine is provided with an engine block having at least one cylindrical bore oriented in a normally upright orientation having an enclosed oil reservoir located below the engine block. A crankshaft is pivotably mounted within the crankshaft chamber. A cam shaft with two cams is pivotably mounted side by side with the crankshaft within the crankshaft chamber and the cam shaft is coupled with said crankshaft by gears such that the cam shaft has a revolution speed that is one-half the revolution speed of said crankshaft. An enclosed oil reservoir is located below the crankshaft chamber. The enclosed oil reservoir, when properly filled, enables the engine to rotate at an angle of at least 30 degrees about the crankshaft axis in either direction without oil within the reservoir rising above the level of the crankshaft counter weight. A pump is connected drivably to said cam shaft, and said pump inhales lubrication oil from the oil reservoir and the valve chamber to splash oil into the crankshaft chamber.

DESCRIPTION OF THE EMBODIMENTS

Figure 1A:
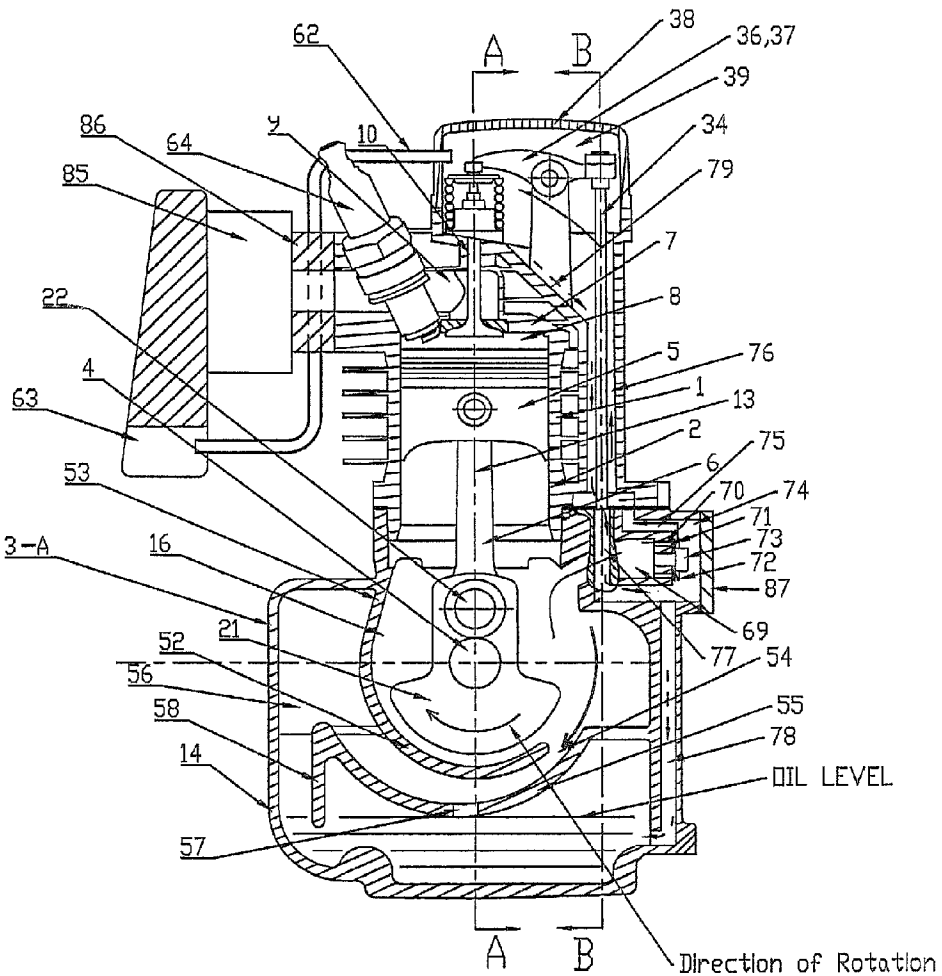
FIG. 1A is a cross-sectional side elevation view of the engine taken along the C-C section of FIG. 3, i.e., along the axis of the cylinder bore and a plane perpendicular to rotating axis of the crankshaft.
Figure 2:
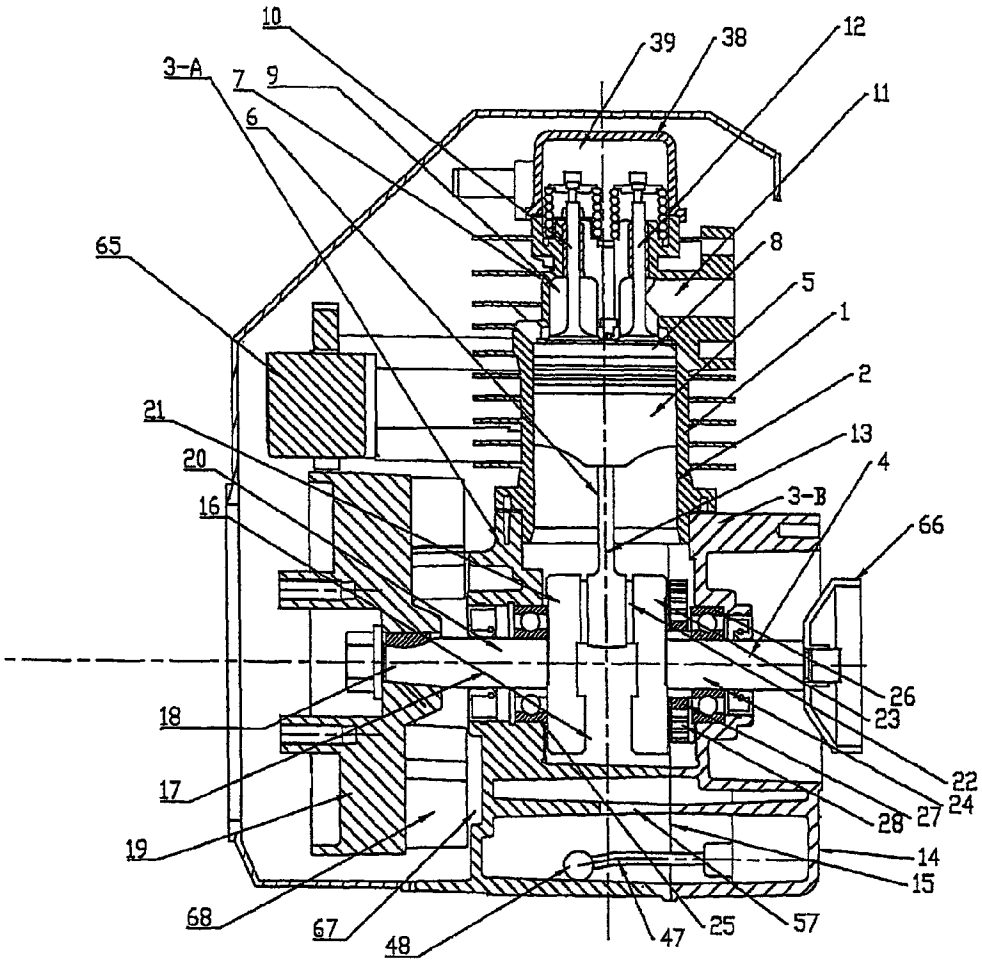
FIG. 2 is a cross-sectional side elevation of the engine taken along the A-A section of FIG. 1A, i.e., along the rotating axis of the crankshaft and axis of cylinder bore.

FIG. 1A and FIG. 2 illustrate a cross-sectional side elevation view of a four-cycle engine. The four-cycle engine is made of a lightweight aluminum housing including a cylinder block 1 having a cylindrical bore 2 formed therein and crankcases 3-A and 3-B.

A crankshaft 4 is pivotably mounted within the crankcases 3-A AND 3-B in a conventional manner.

A piston 5 slides within the cylindrical bore 2 and is connected to the crankshaft by a connecting rod 6.

A cylinder head 7 is affixed to the cylinder block 1 to define an enclosed combustion chamber 8.

The cylinder head 7 is provided with an intake port 9 selectively connected to the combustion chamber 8 by an intake valve 10.

The cylinder head 7 is also provided with an exhaust port 11 selectively connected to the combustion chamber 8 by an exhaust valve 12.

As illustrated in FIGS. 1A and 2, the cylinder axis 13 of four-cycle engine is generally upright when in normal use.

The crankcases 3-A and 3-B provide an enclosed oil reservoir 14.

The crankcases 3-A and crankcase 3-B mate with each other at the interface 15 parallel to section C-C and form a crankshaft chamber 16.

The oil reservoir 14 is relatively deep so that there is ample clearance between the crankshaft 4 and the level of the oil within the oil reservoir 14 during normal use.

The crankshaft 4 is provided with an axial shaft member 17 having an output end 18 adapted to be coupled to a flywheel 19 which connects to the implement input member.

An input end 20 of the axial shaft member 17 is coupled to a counterweight web 21.

A crankpin 22 is affixed to counterweight webs 21, 23 and is parallel to and radially offset from the axial shaft 17.

The crankpin 22 pivotally cooperates with a roller bearing mounted in connecting rod 6.

The axial shafts 17 and 24 of crankshaft 4 are pivotably attached to a set of crankcase 3-A and crankcase 3-B by a pair of bearings 25 and 26.

At the side of the bearing 26 is a crank gear 27.

Figure 3:
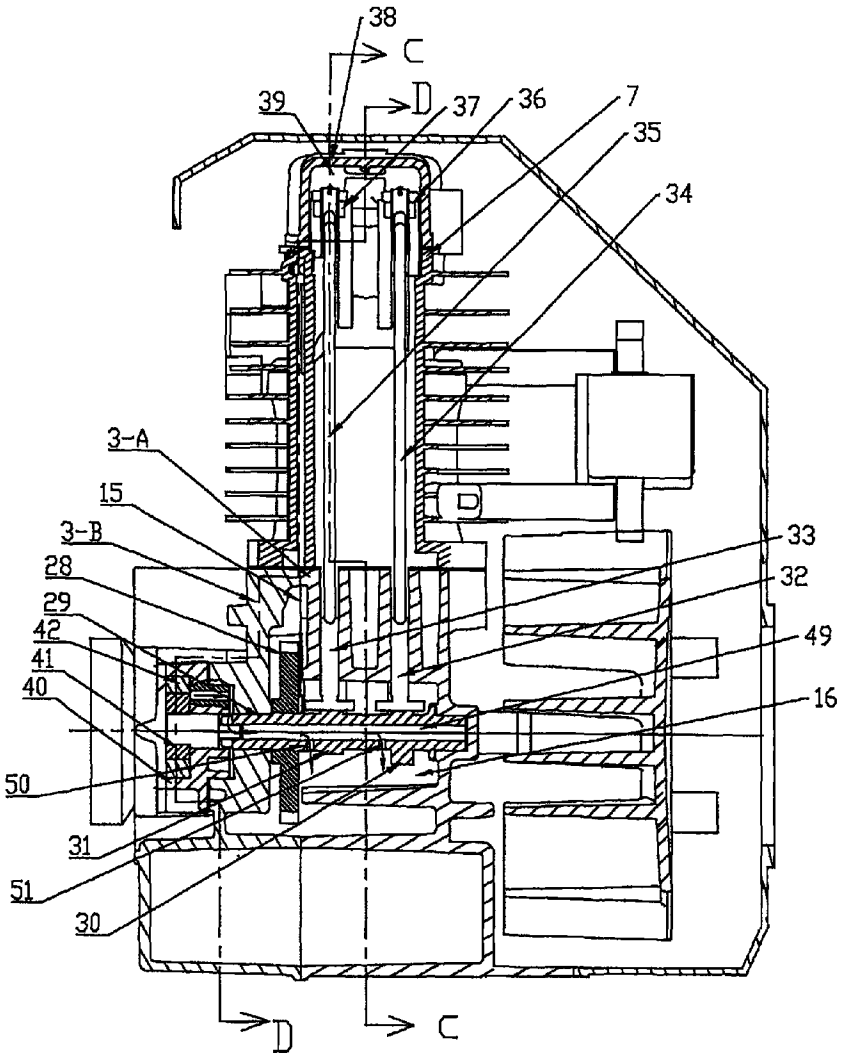
FIG. 3 is a cross-sectional side elevation of the engine taken along the rotating axis of the camshaft and parallel to the section A-A.

The camshaft drive and tappet mechanism is best illustrated in FIG. 3.

As previously illustrated, the crank gear 27 is mounted on the crankshaft 4, which in turn drives a cam gear 28 with twice the number of teeth as the crank gear 27 resulting in the camshaft 29 rotating at one-half the speed of the crankshaft speed.

The cam gear 28 is affixed to a camshaft 29 which is journaled to the crankcases 3-A and 3-B and includes two rotary inlet cam lobe 30 and exhaust cam lobe 31.

Tappets 32 and 33 are slidably inserted to the crankcase 3-A and contact the cam lobes 30 and 31, respectively.

Push rods 34 and 35 extend between the tappets 32 and 33 and rocker arms 36 and 37 located within the cylinder head 7.

The cams 30, 31, push rods 34, 35 and rocker arms 36, 37 are part of a valve train assembly.

Affixed to the cylinder head 7 is a valve cover 38 which defines an enclosed valve chamber 39 between the cylinder head and the valve cover.

In order to lubricate the engine, a pump 40 such as a trochoid pump is placed at the side of cam gear 28. The pump 40 has an inner rotor 41 and an outer rotor 42. In other embodiments of the present application, a gear pump or plunger pump may be used.

The inner rotor 41 is driven by the cam shaft 29 and the outer rotor 42 is rotated following the rotation of the inner rotor 41.

Lubrication oil is inhaled from the flexible tube passage 47. An end of the flexible tube passage 47 leads to the oil entrance of the pump. The other end of flexible tube passage 47 is connected to a filter with weight 48. By means of the weight 48, the entrance of the flexible tube passage is dipped in the oil in the oil reservoir 17 at any orientation of the engine.

The oil pushed out by the pump is lead to the cylinder bore through an inner hole 49 of the cam shaft 29 and holes 50 and 51 at the cam shaft 29 as illustrated in FIG. 3. Accordingly, the engine parts inside the cylinder and the crankshaft room are then mist lubricated by the oil splashed by means of the rotation of, and/or the centrifugal force generated by, the rotating parts such as webs 21, 23, cam shaft 29 and the cam gear 28.

As illustrated in FIGS. 1A and 2, a first wall or a circular arc wall 52 surrounding the counterweight webs 21, 23 of the crankshaft 4 is extended from the walls of crankcase 3-A and crankcase 3-B. The arc wall 52 is co-axial with the axis of the counterweight web 21 or 23. The distance between the web 21 or 23 and the inner face of the arc wall is made narrow for the reason as set forth below. An end 53 of arc wall 52, which is downstream of the rotation of web 21 or 23, is connected to the inner wall of crankcase 3-A or crankcase 3-B, while an oil entrance 54 is provided between arc wall 52 and the walls of crankcase 3-A and crankcase 3-B, as illustrated in FIG. 1A.

Around the entrance 54, a second wall or a scrolled wall 55 is provided. As illustrated in FIG. 1A, the scrolled wall 55 is located a certain distance from the arc wall 52. This distance increases with the rotation of the counterweight webs 21 and 23. The end of wall 55, located at the upstream side of rotation of counterweight web 21 or 23, is connected to the inner wall of crankcase 3-A or crankcase 3-B. Another side of the space between the wall 52 and the wall 55 has an outlet 56, which is located at the top of the oil reservoir 14.

A hole (or holes) 57 is provided on the wall 55 at the portion near the oil reservoir to drain the oil from the scrolled surface of the wall 55 to the oil reservoir 14.

The arc wall 52 and the scrolled wall 55 are overlapped as illustrated in FIG. 1A. At the corner of the scrolled wall 55 proximate the outlet 56, an extended wall 58 is provided to the oil reservoir 14.

Figure 4:
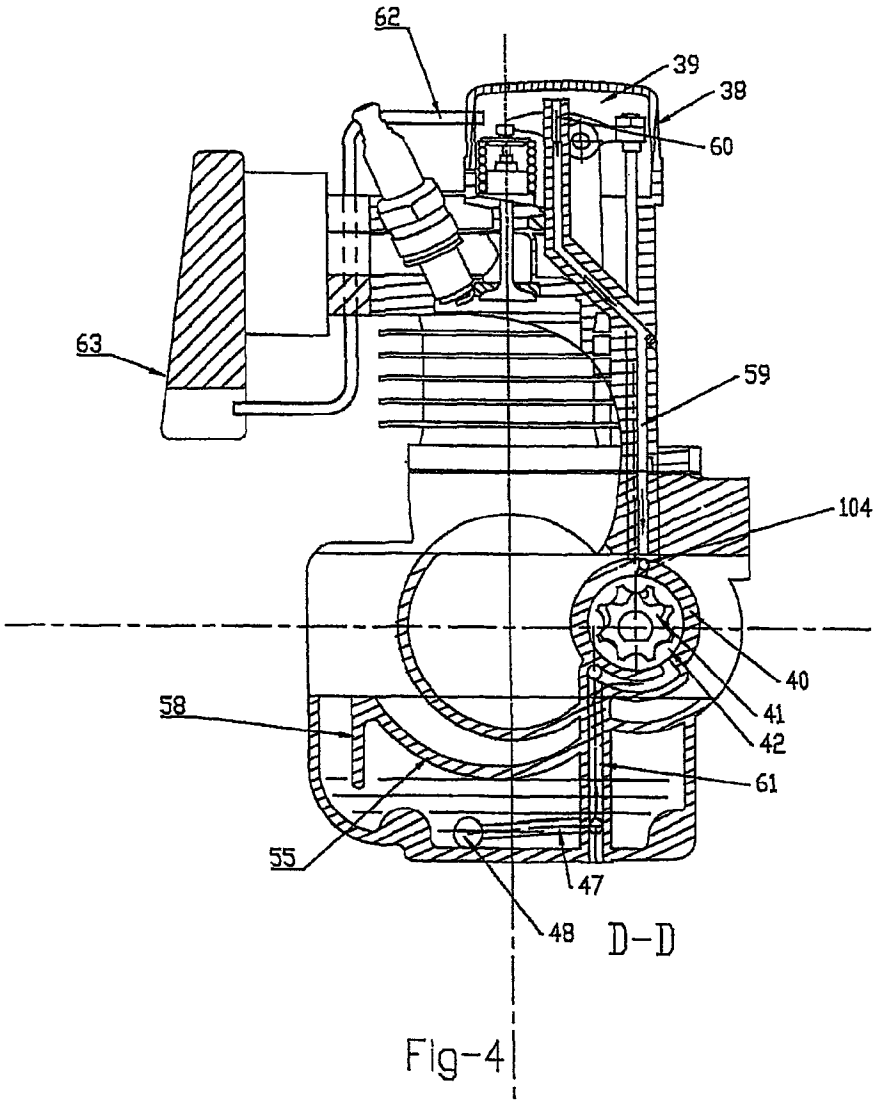
FIG. 4 is the D-D section of FIG. 3 and a side elevation view of the engine.
Figure 5:
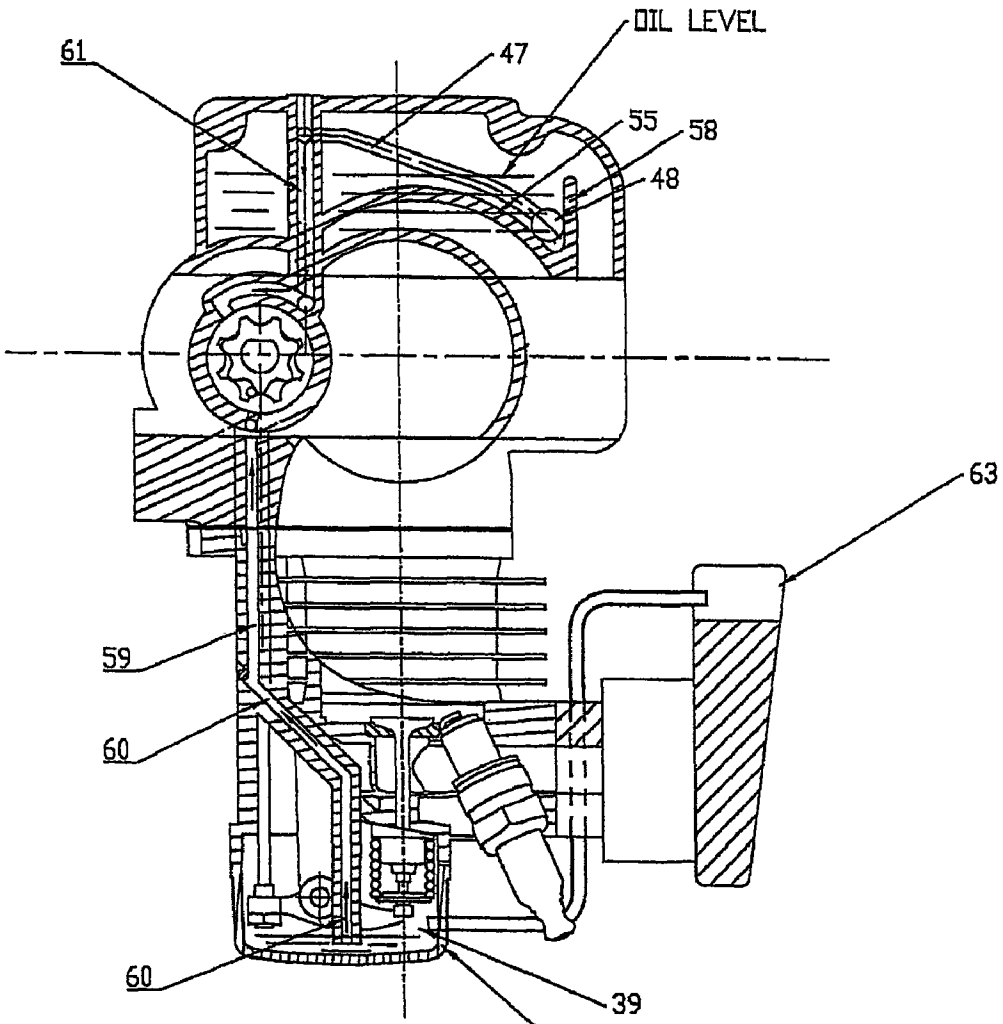
FIG. 5 is the D-D section of FIG. 3 and a side elevation view of the engine when the engine is oriented to be upside down.

At the side of the cylinder block 1, a drilled oil passage 59 is provided. An end of passage 59 leads to an upper portion in the valve chamber 39 through a small hole 60, as illustrated in FIGS. 4 and 5. FIG. 5 shows a view of the engine when the engine is postured upside down.

Figure 6:
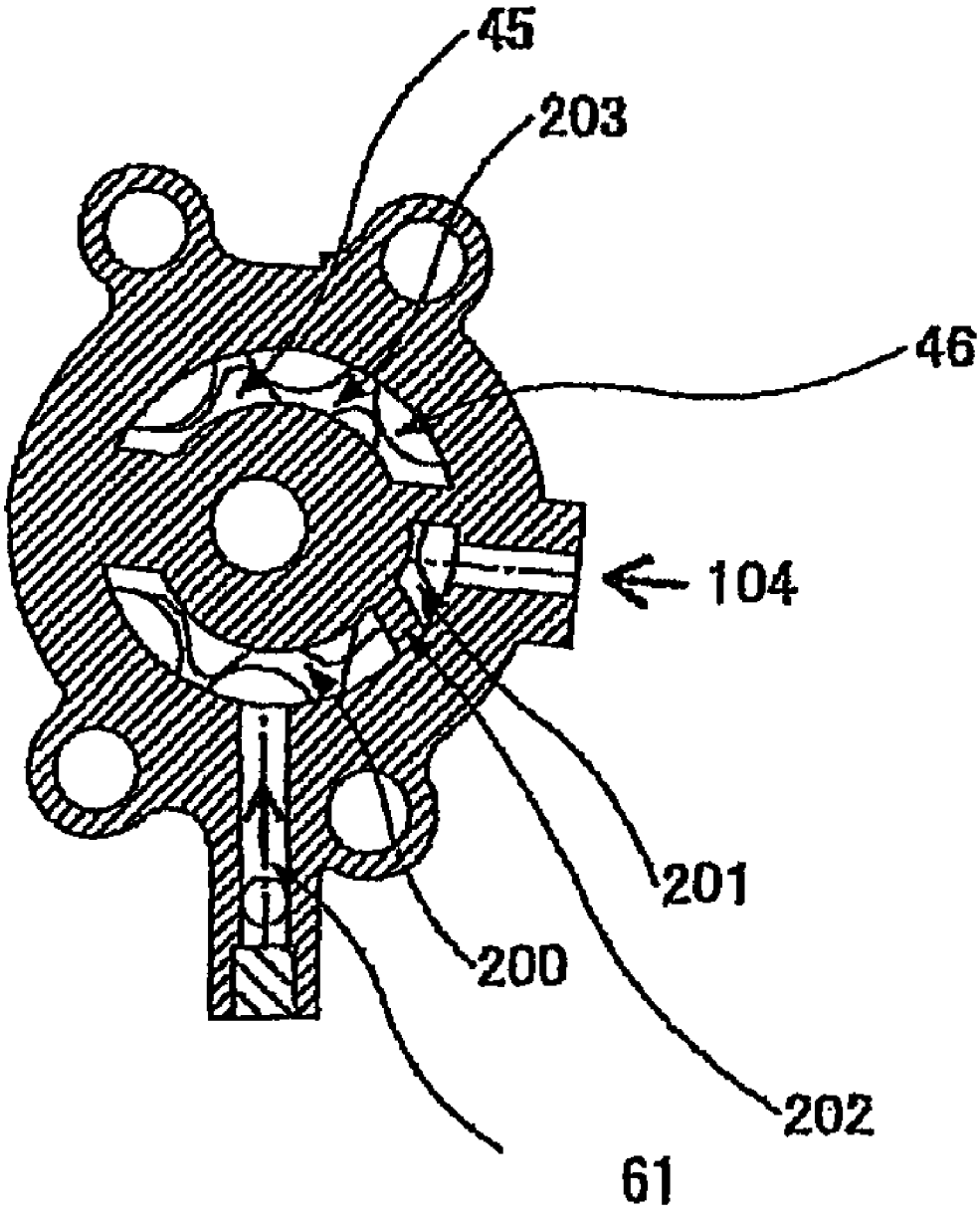
FIG. 6 is a section view of the oil pump that shows the detail construction of inlet cavity of the pump.

As illustrated in FIG. 6, the pump 40 has a first inlet cavity 200 which inhales oil from the oil reservoir 14 through flexible tube 47 and oil passage 61, and a second inlet cavity 201 which inhales oil from the valve chamber 39 through passage 59 and inlet 104.

Between the first inlet cavity 200 and the second inlet cavity 201, a wall 202 is provided to separate the cavities 200 and 201. An outlet cavity 203 provides a passage for oil to the crankshaft chamber 16 through a hole 49 in the cam shaft 29.

In the valve chamber 39, a breather pipe 62 is opened through the valve cover 38 and is connected to an air cleaner case 63.

A carburetor 85 and an insulator 86 are provided in a conventional way between air cleaner case 63 and inlet port 9 as illustrated in FIG. 1A.

A spark plug 64 is installed in a spark plug hole formed in the cylinder head.

Numeral 65 is an ignition coil. A re-coil starter, which is not shown, is connected to starter pulley 66, which is connected to the side of crankshaft 4.

At the side of the crankcase 3-A, a cooling air entrance 67 is provided which inhales cooling air for the engine generated by rotation of blade 68 on the flywheel 19.

In order to achieve high power output and relatively low exhaust emissions, the four-cycle engine is provided with a very compact combustion chamber 7 and with adequately located inlet and exhaust ports 9, 11 which are not inline each other to produce a swirl when an air-fuel mixture is inhaled.

At the upper portion of the crankshaft chamber between the wall of crankcase 3-A and a boss to support tappets 32, 33, a cavity 69 is provided. At the side wall of the cavity 69, holes 70 are provided. A check valve 71 made of an elastic material is provided between the side wall of cavity 69 and a guide plate 72 by fastening by a screw 73.

At the outside of the check valve 71, a breather room 74 is provided which is sealed by cover 87, as illustrated in FIG. 1A. The breather room 74 leads to a first passage 75, in the breather room 74, which in turn, leads to a second passage 76 between the cylinder block 1 and the push rods 34, 35.

Just below the second passage 76 of cylinder block 1, a fourth passage 77 in crankcase 3-A leads to the lower portion of breather room 74. A fifth passage 78 is provided between the lower portion of breather room 74 and the lower portion of oil reservoir 14. A hole at an end of the fifth passage 78 is under the oil level at the normal operation condition of the engine as illustrated in FIG. 1A.

Figure 7:
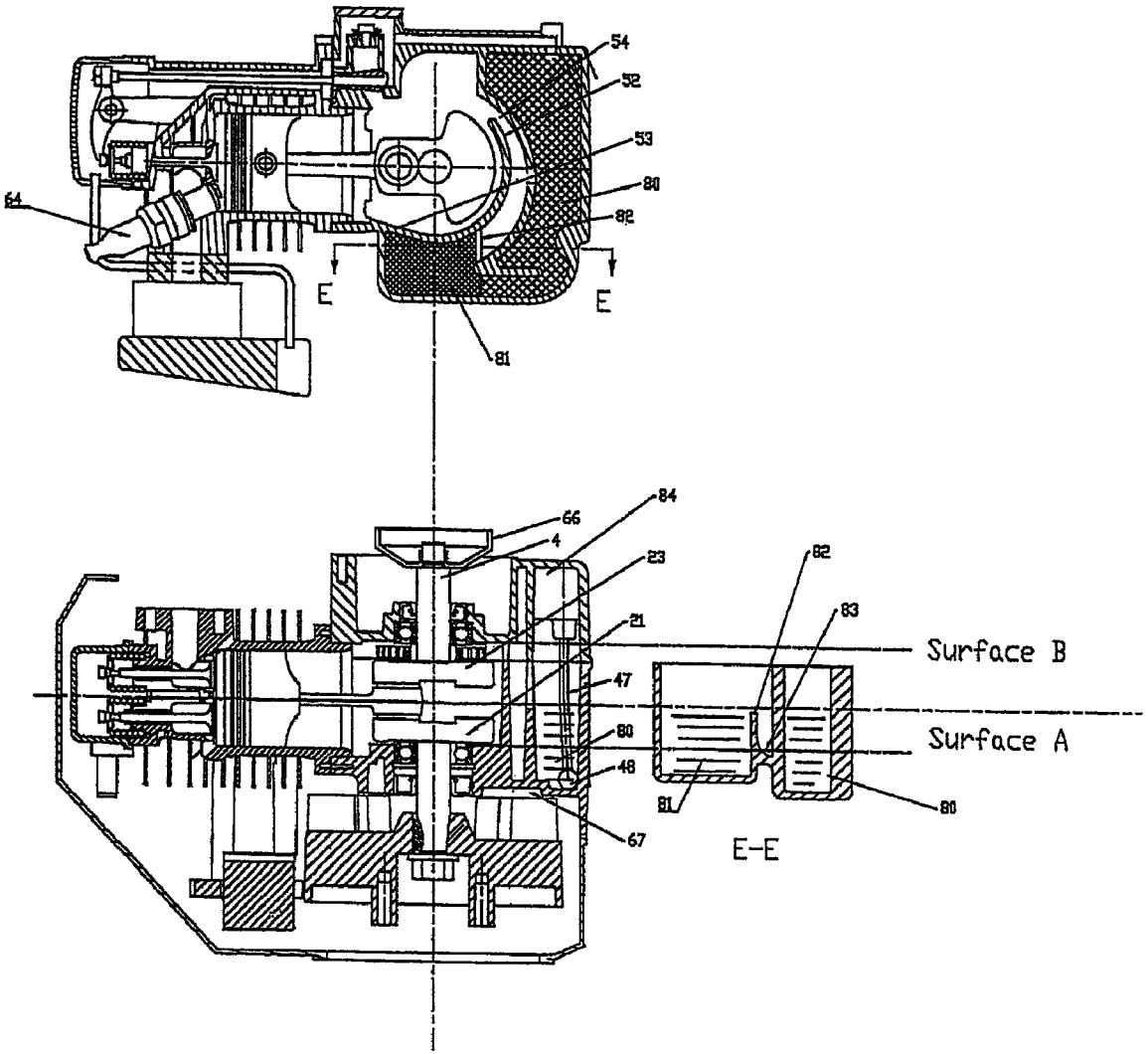
FIG. 7 is as same as FIG. 2 but the engine is oriented to be implement side (namely, flywheel side) up and starter side down.

As illustrated in FIG. 7, the crankcase 3-A has a cavity 80 and 81 to extrude from the surface A which faces closely to the web 21 of crankshaft 4. A weir 82 is provided to extend from surface A to the direction of axis 13. At the root of weir 82 a radius 83 is provided. Further, the crankcase 3-B has a cavity 84 to extrude from surface B which faces closely to the web 22 of crankshaft 4.

When the engine is started by pulling the winding rope of the re-coil starter (not shown) and the starter pulley 66 illustrated in FIG. 2 is rotated, inner and outer rotors 41, 42 of the oil pump 40 is driven by the cam shaft 29 as illustrated in FIG. 3. Then, lubricating oil is immediately inhaled to the oil pump 40 through the flexible tube 47 and the oil passage 61, as illustrated in FIG. 4. As illustrated in FIG. 3, lubricating oil is pushed to flow into inner hole 49 and splashed into the crankshaft chamber 16 through the holes 50 and 51. By means of the weight 48 supported by and connected to the flexible tube 47, oil is inhaled at any position of the engine.

By means of rotation of the crankshaft 4 or the webs 21, 23, a motion of the connecting rod 6 or the piston 5, lubricating oil produces mist, which is mixture of oil and air, and lubricates rotating and reciprocating parts in the crankshaft chamber 16, including the cam shaft 29 and the tappets 32, 33.

The check valve 71 is installed such that it opens when the pressure in crankshaft chamber 16 is higher than the pressure in the breather room 74 and closes when the pressure in the crankshaft chamber 16 is lower than the pressure in the breather room 74.

When the pressure in the crankshaft chamber 16 is higher than the pressure in the breather room 74 by the reciprocating motion of piston 5, the oil mist in the crankshaft room 16 is pushed out to the breather room 74 through holes 70 and the check valve 71.

The breather room 74 leads to the valve chamber 39 through the first passage 75 and the second passage 76. Since the valve chamber 39 leads to the air cleaner case 63 through the breather tube 62 as a third passage, pressure in the breather tube 62 or the valve chamber 39 is the same as the atmospheric pressure and gas in the breather tube 62 is inhaled slightly to the air cleaner when the engine is operated. Thus, a mist of lubricating oil is sent to the valve chamber 39 through the second passage 76 and lubricates the valves After lubricating parts in the valve chamber, liquid oil is produced from the oil mist and drips from the valve chamber 39 through the inclined deck 79 in the valve chamber and the second passage 76 and the fourth passage 77 to the breather room 74.

For reasons mentioned above, the pressure in the breather room 74 is almost the same as the atmospheric pressure. A motion of the check valve 71 makes the pressure in the crankshaft room 16 the same as the atmospheric pressure when the piston 5 goes down and makes the pressure lower than the atmospheric pressure when the piston 5 goes up, so that a mean pressure in the crankshaft room is lower than the atmospheric pressure. Further, the pressure in the crankshaft room is almost the same as the pressure in the oil reservoir 14. Therefore, any dripped liquid oil in the breather room 74 flows back in to the oil reservoir through the fifth passage 78 by the pressure difference between the breather room 74 and the oil reservoir 14.

Figure 1B:
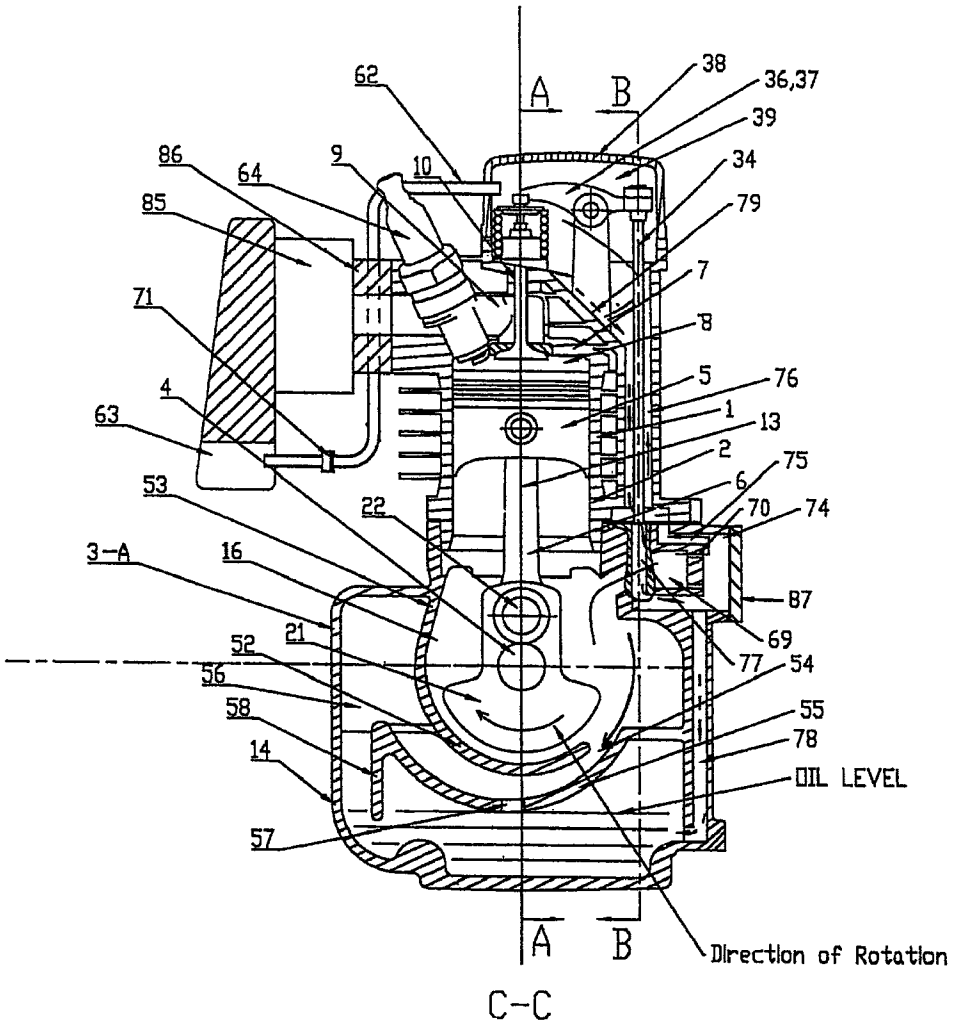
FIG. 1B is a cross-sectional side elevation view of the engine according to another embodiment of the present invention similar to FIG. 1A.
Figure 1C:
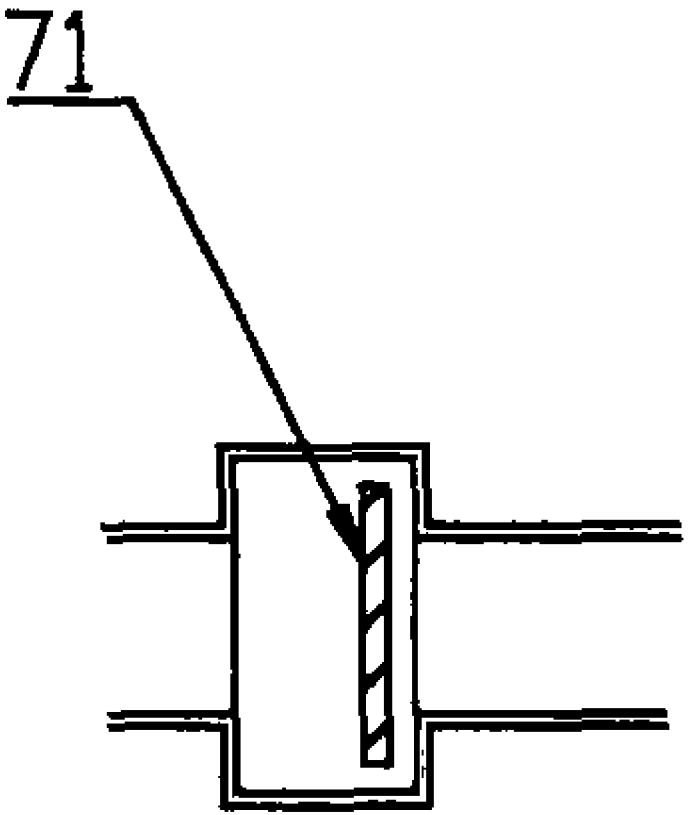
FIG. 1C is a detailed view showing the check valve in the breather tube.

The check valve 71 is not necessarily located as shown in FIG. 1A. FIG. 1B shows another embodiment of this invention. In FIG. 1B, check valve 71 is provided in breather tube 62 (see FIG. 1C). In this embodiment, the check valve 71 is installed such that it opens when the pressure in valve chamber 39 is higher than the pressure in the air cleaner box 63 and closes when the pressure in the valve chamber 39 is lower than the pressure in the air cleaner box 63.

When the pressure in the crankshaft chamber 16 is higher than the pressure in the breather room 74 by the reciprocating motion of piston 5, the oil mist in the crankshaft room 16 is pushed out to the breather room 74 through holes 70.

The breather room 74 leads to the valve chamber 39 through the first passage 75 and the second passage 76. Since the valve chamber 39 leads to the air cleaner case 63 through the breather tuber 62 as the third passage and check valve 71, pressure in the air cleaner box side of the breather tube 62 is the same as the atmospheric pressure and gas in the breather tube 62 is inhaled slightly to the air cleaner when the engine is operated. Thus, a mist of lubricating oil is sent to the valve chamber 39 through the second passage 76 and lubricates the valves 10, 12, and the rocker arms 36, 37 in the valve chamber.

After lubricating parts in the valve chamber, liquid oil is produced from the oil mist and drips from the valve chamber 39 through the inclined deck 79 in the valve chamber and the second passage 76 and the fourth passage 77 to the breather room 74.

For reasons mentioned above, the pressure in the valve chamber and the breather room 74 is much lower than the atmospheric pressure. A small hole 70 makes the pressure in the crankshaft room 16 the same as the pressure in the breather room 74 when the piston 5 goes down and makes the pressure lower than the pressure in the breather room when the piston 5 goes up, so that a mean pressure in the crankshaft room is lower than the pressure in the breather room 74. Therefore, any dripped liquid oil in the breather room 74 flows back in to the oil reservoir through the fifth passage 78 by the pressure difference between the breather room 74 and the oil reservoir 14.

As illustrated above, the circular arc wall 52 surrounds the counterweight webs 21, 23 a slight distance away from the counterweight web. The scroll-shaped wall 55 is separated by a gradually increased distance from the circular arc wall 52 in the direction of the counterweight webs 21 and 23 and has partially overlaps the circular arc wall 52. The counterweight webs 21 and 23 splash the oil to mist lubricate the internal engine parts. After lubricating the engine parts, as the webs 21, 23 rotate, the oil is forced to return to the oil reservoir 17 guided by the scroll-shaped wall 55 at any posture of engine due to the viscosity of the oil situated between the webs 21, 23 and the circular arc wall 52, and due to the centrifugal force generated by the webs 21, 23. Further, the oil at the scrolled wall 52 is drained through the hole 57 to the oil reservoir 17.

As illustrated in FIG. 4, when the engine is in a normal orientation, the lubricating oil is inhaled by pump 40 through the passage 61 from the oil reservoir 17 and any excess oil in the valve chamber after lubricating various parts is also inhaled by pump 40 through the small hole 60 in the valve chamber.

As illustrated in FIG. 5, when the engine is positioned upside down, the oil, after lubricating various parts in the valve chamber, is inhaled by pump 40 from the small hole 60 and sent to the oil reservoir 17. Accordingly, excess oil does not remain in the valve chamber.

Further, when the engine is driven with posture upside down, lubrication oil is kept in the oil reservoir 17, helped by the extended wall 58, and the oil is prevented from flowing into the cylinder head part.

As illustrated in FIG. 7, when a hand held engine is not operating, it is usually kept in a position with the flywheel side down and implement side up. In this position, as illustrated in FIG. 7, oil is kept within the cavities 80 and 81 helped by the walls 52, 55 and the weir 82 and this position prevents oil flow in to combustion chamber.

It is believed that small lightweight four cycle engines made in accordance with the present invention will be particularly suitable for use with hand-held or transportable power tools having low emissions and is sufficiently light to be carried and/or transported by an operator. In the prior art, various kinds of lubricating methods for hand-held or transportable power tools have been presented. However, most of these methods require more than one complicated check valve systems to control a flow of lubricating oil in the engine and to prevent oil from flowing into a cylinder head when the engine is positioned upside down. In the present invention, however, only one part is required to form the check valve mechanism because the pump 40 supplies pressurized oil to the crankshaft chamber and breathing mist oil is easily sent to the valve chamber by operation of a check valve. Therefore, the engine structure is simpler, which in turn reduces weight and cost.

Further, the pump in the present invention is very low cost because it can be made easily by machining, an injection molding process, and/or a powder compaction molding process.

Another advantage is that the present invention provides better cooling performance. In the prior arts, some engines use, so to speak, dry sump lubrication. In dry sump lubrication, any over heating of oil could ruin or impair lubrication performance. As illustrated in FIG. 1A, the present invention looks similar to dry sump lubrication, but differs in the following points. First, a lot of lubrication oil is sent by the oil pump. Second, there is a space between the arc and the scrolled walls. This space prevents heat flow between the crankcase and the oil reservoir and consequently the oil temperature of the oil in the reservoir is lower than it is for the current dry sump engines. Further, as illustrated in FIG. 2, cooling air is inhaled around the oil reservoir, wherein, since the temperature of the oil reservoir is lower than it is for dry sump engines, the cooling air is not heated so much as the current dry sump engines and, as a result, the engine can be cooled more effectively. The improved cooling may reduce emissions by reducing the energy to cool engine.

Another advantage is that the present invention make the longitudinal length of engine shorter than the prior art, because a cam shaft is positioned side by side with a crankshaft, while, in the prior art, a cam lobe is located at the extension of the end of crankshaft.

While the present invention is discussed in relation to an engine to be used with portable or transportable power tools, a person having ordinary skill in the art will readily realize that it can be also used with stationary power tools or equipment.

What is claimed is:

1. A single-cylinder, four-stroke cycle, spark ignition internal combustion engine for mounting on a power tool comprising:

a cylinder block having a cylinder, a cylinder head, a piston mounted for reciprocation in said cylinder, said cylinder head defining an air-fuel combustion chamber;

an air-fuel mixture intake port and an exhaust gas port in said cylinder head;

a valve cover on said cylinder head defining a valve chamber;

an intake valve and an exhaust valve mounted in said intake and exhaust port, respectively, for reciprocation between port-open and port-closed positions;

a valve-actuating valve train, said valve train including at least one rocker arm and at least one valve train push rod assembly extending therefrom within said valve chamber and engaging said rocker arm;

a crankshaft rotatably mounted in a crankcase, said crankshaft includes a crank portion and at least one counterweight web;

a connecting rod having articulated connections at one end thereof to said piston and at an opposite end thereof to said crank portion, thereby forming a piston-connecting rod crankshaft assembly;

at least one cam shaft with a cam to actuate inlet valve and a cam to actuate exhaust cam rotatably mounted in a crank shaft chamber, said at least one cam shaft being drivably connected by cam gear on it with crank gear on said crank shaft, said at least one cam shaft driven at one-half crankshaft speed;

tappets which reciprocate in said cylinder block driven by said inlet cam and exhaust cam respectively;

at least one push rod assembly inserted in said cylinder block, an end of push rod being connected with rocker arm in valve chamber, the opposite end of said tappets being drivably connected to said tappet whereby said push rod assembly is actuated with a reciprocating motion of tappet upon rotation of said inlet and exhaust cam, a lubrication oil reservoir formed below the crankcase;

an oil pump connected drivably to said cam shaft, with said oil pump including a first and second inlet cavity with each cavity being separated by a wall in an arrangement such that the first inlet cavity is in direct communication with the oil reservoir for inhaling oil therefrom and the second inlet cavity is in direct communication with the valve chamber formed on the cylinder head for inhaling oil from the valve chamber such that oil is splashed from both the oil reservoir and the valve chamber into the crank shaft chamber to lubricate the engine parts inside the crank shaft chamber.

2. The engine set forth in claim 1 further comprising:

a breather room at outside of a wall of said crankcase, a check valve provided at a wall of crankcase in said breather room, wherein said check valve opens and allows flow of breathing oil mist gas from said crank shaft room to said breather room when the pressure in crank shaft room is higher than the pressure in said breather room by reciprocating motion of said piston and closes and does not allow flow of breathing oil mist gas from said crank shaft room to said breather room when the pressure in crank shaft room is lower than the pressure in said breather room by reciprocating motion of said piston;

a first passage to supply breathing oil mist from said breather room to a second passage provided around push rods surrounding by wall of cylinder and leads to said valve chamber, wherein oil mist is pushed out from crank shaft chamber to breather room and is supplied from breather room to valve chamber through first and second passages and lubricates various parts in said valve chamber;

an air cleaner box connected to said valve chamber via a third passage through which breathing oil mist gas flows;

a fourth passage connected at the bottom of said second passage and leads to said breather room;

a fifth passage connected at the bottom of said breather room and leads to oil reservoir;

a deck of said valve chamber, which is inclined to a plane which is perpendicular to the cylinder axis;

wherein, oil in the oil mist after lubricates parts in said valve chamber is separated to form droplets, which drop on the said deck and drop to oil reservoir through second, fourth and fifth passages helped by pressure difference between valve chamber and oil reservoir.

3. The engine set forth in claim 1 comprising:

a breather room at outside of a wall of said crankcase;

a check valve provided at the third passage between a valve chamber and an air cleaner box, wherein said check valve opens and allows flow of breathing oil mist gas from said valve chamber to said air cleaner box when the pressure in said valve chamber is higher than the pressure in said air cleaner box room by reciprocating motion of said piston and closes and does not allow flow of breathing oil mist gas from said valve chamber to said air cleaner box when the pressure in said valve chamber is lower than the pressure in said air cleaner box by reciprocating motion of said piston.

4. The engine set forth in claim 1, further comprising:

a first wall at least partially surrounding said web having a slight distance therefrom; and a second wall at least partially surrounding said first wall having a distance gradually increasing toward the downstream of the direction of the rotation of said web;

wherein said web splashes the oil to lubricate the internal engine parts and, after lubricating the internal engine parts, the oil is forced to return into said oil reservoir guided by said second wall as the web rotates due to the viscosity of the oil between said web and the first wall.

5. The engine set forth in claim 1, wherein said oil pump is a trochoid pump.

6. The engine set forth in claim 1, wherein said oil pump is a gear pump.

7. The engine set forth in claim 1, wherein said oil pump is a plunger pump.

8. A hand-held, transportable, or stationary power tools driven by the engine set forth in claim 1, wherein said power tools are driven by horizontal or vertical or inclined power shaft.

9. The engine set forth in claim 4, wherein said second wall has an extended wall which prevents the oil in the oil reservoir from flowing out when engine is inclined at any position.

10. The engine set forth in claim 4, wherein said first and second walls are formed by mating a set of crankcase.

11. The engine set forth in claim 4, wherein said second wall has a hole or holes to drain oil to the oil reservoir.

12. The engine set forth in claim 4, wherein at least one weir is provided between first wall and second wall or between first and extended wall to prevent flowing out of oil in oil reservoir in to combustion chamber when engine is kept with orientation to be power take off side up or power take off side down.

13. The engine set forth in claim 2, further comprising:

a first wall at least partially surrounding said web having a slight distance therefrom; and a second wall at least partially surrounding said first wall having a distance gradually increasing toward the downstream of the direction of the rotation of said web, wherein said web splashes the oil to lubricate the internal engine parts and, after lubricating the internal engine parts, the oil is forced to return into said oil reservoir guided by said second wall as the web rotates due to the viscosity of the oil between said web and the first wall.

14. The engine set forth in claim 3, further comprising:

a first wall at least partially surrounding said web having a slight distance therefrom; and a second wall at least partially surrounding said first wall having a distance gradually increasing toward the downstream of the direction of the rotation of said web, wherein said web splashes the oil to lubricate the internal engine parts and, after lubricating the internal engine parts, the oil is forced to return into said oil reservoir guided by said second wall as the web rotates due to the viscosity of the oil between said web and the first wall.

15. The engine set forth in claim 2, wherein said oil pump is a trochoid pump.

16. The engine set forth in claim 3, wherein said oil pump is a trochoid pump.

17. The engine set forth in claim 2, wherein said oil pump is a gear pump.

18. The engine set forth in claim 3, wherein said oil pump is a gear pump.

19. The engine set forth in claim 2, wherein said oil pump is a plunger pump.

20. The engine set forth in claim 3, wherein said oil pump is a plunger pump.

21. A hand-held, transportable, or stationary power tools driven by the engine set forth in claim 2, wherein said power tools are driven by horizontal or vertical or inclined power shaft.

22. A hand-held, transportable, or stationary power tools driven by the engine set forth in claim 3, wherein said power tools are driven by horizontal or vertical or inclined power shaft.

23. The engine set forth in claim 4, wherein said first and second walls are formed by mating a set of crankcase.

24. The engine set forth in claim 4, wherein said first and second walls are formed by mating a set of crankcase.

25. The engine set forth in claim 4, wherein said second wall has a hole or holes to drain oil to the oil reservoir.

26. The engine set forth in claim 4, wherein said second wall has a hole or holes to drain oil to the oil reservoir.

27. The engine set forth in claim 4, wherein at least one weir is provided between first wall and second wall or between first and extended wall to prevent flowing out of oil in oil reservoir in to combustion chamber when engine is kept with orientation to be power take off side up or power take off side down.

28. The engine set forth in claim 4, wherein at least one weir is provided between first wall and second wall or between first and extended wall to prevent flowing out of oil in oil reservoir in to combustion chamber when engine is kept with orientation to be power take off side up or power take off side down.

* * * * *

UNITED STATES PATENT AND TRADEMARK OFFICE

CERTIFICATE OF CORRECTION

PATENT NO. : 8,281,758 B2
APPLICATION NO. : 12/470006
DATED : October 9, 2012
INVENTOR(S) : Kurihara et al.

It is certified that error appears in the above-identified patent and that said Letters Patent is hereby corrected as shown below:

Title Page, Item (57), should read:

ABSTRACT

A four-cycle engine with an enclosed oil reservoir for mounting on a power tool is provided. An oil pump driven by a camshaft, which mates by a cam gear with crank gear that is driven by a crank shaft, inhales the oil from the oil reservoir to lubricate the engine parts. A circular arc wall surrounds around web of the crankshaft with a slight distance from the web. A scroll-shaped wall has gradually increased distance from the circular arc wall to the direction of rotation the web and has partial overlap with the circular arc wall. In case of stock of engine oriented power take off side up or down, oil is prevented to flow from oil reservoir to combustion chamber by a weir which is provided between the circular arc wall and the scrolled wall. The check valve splashes breathing mist oil from the crankshaft to the breather room and causes the oil to supply lubricant to lubricate the engine parts.

Signed and Sealed this
Twenty-eighth Day of May, 2013

Teresa Stanek Rea

Teresa Stanek Rea
*Acting Director of the United States Patent and Trademark Office*

UNITED STATES PATENT AND TRADEMARK OFFICE

CERTIFICATE OF CORRECTION

PATENT NO. : 8,281,758 B2
APPLICATION NO. : 12/470006
DATED : October 9, 2012
INVENTOR(S) : Kurihara et al.

It is certified that error appears in the above-identified patent and that said Letters Patent is hereby corrected as shown below:

Title Page, Item (57), should read:

ABSTRACT

A four-cycle engine with an enclosed oil reservoir for mounting on a power tool is provided. An oil pump driven by a camshaft, which mates by a cam gear with crank gear that is driven by a crank shaft, inhales the oil from the oil reservoir to lubricate the engine parts. A circular arc wall surrounds around web of the crankshaft with a slight distance from the web. A scroll-shaped wall has gradually increased distance from the circular arc wall to the direction of rotation of the web and has partial overlap with the circular arc wall. In case of stock of engine oriented power take off side up or down, oil is prevented to flow from oil reservoir to combustion chamber by a weir which is provided between the circular arc wall and the scrolled wall. The check valve splashes breathing mist oil from the crankshaft to the breather room and causes the oil to supply lubricant to lubricate the engine parts.

This certificate supersedes the Certificate of Correction issued May 28, 2013.

Signed and Sealed this
Third Day of September, 2013

Teresa Stanek Rea
*Acting Director of the United States Patent and Trademark Office*